US008695462B1

(12) United States Patent
Jorgensen

(10) Patent No.: US 8,695,462 B1
(45) Date of Patent: Apr. 15, 2014

(54) ADJUSTABLE WRENCH

(75) Inventor: Timothy David Jorgensen, Burlington, NC (US)

(73) Assignee: Jist Unlimited, LLC, Burlington, NC (US)

( * ) Notice: Subject to any disclaimer, the term of this patent is extended or adjusted under 35 U.S.C. 154(b) by 303 days.

(21) Appl. No.: 13/253,548

(22) Filed: Oct. 5, 2011

Related U.S. Application Data

(60) Provisional application No. 61/390,676, filed on Oct. 7, 2010.

(51) Int. Cl.
*B25B 13/20* (2006.01)

(52) U.S. Cl.
USPC ..... 81/129

(58) Field of Classification Search
USPC ..... 81/129, 179, 109, DIG. 5
See application file for complete search history.

(56) References Cited

U.S. PATENT DOCUMENTS

| | | | | | |
|---|---|---|---|---|---|
| 58,306 | A | | 9/1866 | Sedgwick | |
| 98,393 | A | | 12/1869 | Magee | |
| 172,649 | A | * | 1/1876 | Pease | 81/129 |
| 920,536 | A | | 5/1909 | Caldwell | |
| 1,018,528 | A | | 2/1912 | Suddarth | |
| 1,176,328 | A | | 3/1916 | Tressler | |
| 1,332,922 | A | | 3/1920 | Short | |
| 1,422,563 | A | * | 7/1922 | Graham | 81/129 |
| 1,466,502 | A | * | 8/1923 | Garbacz | 81/129 |
| 1,498,656 | A | | 6/1924 | Herby | |
| 1,530,842 | A | | 6/1925 | Matoushek | |
| 1,571,326 | A | | 2/1926 | Faulkner | |
| 1,616,612 | A | * | 2/1927 | Dodds | 81/129 |
| 1,652,355 | A | | 12/1927 | Hammer | |
| 1,715,426 | A | * | 6/1929 | Peterson | 81/129 |
| 1,811,148 | A | | 6/1931 | Pehrsson | |
| 1,828,561 | A | | 10/1931 | Garrison | |
| 2,001,789 | A | | 5/1935 | Leaveck | 81/175 |
| 2,053,033 | A | | 9/1936 | Ibbett | 81/128 |
| 2,181,012 | A | | 11/1939 | Bunting | 81/64 |
| 2,280,594 | A | | 4/1942 | Malagrino | 81/143 |
| 2,375,082 | A | | 5/1943 | Colley | 81/86 |
| 2,350,097 | A | | 5/1944 | Conner | 81/185 |
| 2,572,492 | A | | 9/1948 | Kempf | 76/114 |
| 2,458,794 | A | | 1/1949 | Ogden | 81/165 |
| 2,471,537 | A | | 3/1949 | Norman | 81/91 |
| 2,498,235 | A | | 2/1950 | Barber | 81/78 |
| 2,596,882 | A | | 5/1952 | Wiesen | 81/185 |
| 2,669,146 | A | | 2/1954 | Florence | 81/91 |
| 2,722,150 | A | | 11/1955 | Green | 81/165 |
| 2,724,301 | A | | 11/1955 | Parent et al. | 81/145 |
| 2,739,500 | A | | 3/1956 | Kordish | 81/163 |
| 2,801,562 | A | | 8/1957 | Stricklett et al. | 81/163 |
| 2,849,908 | A | | 9/1958 | Swanstrom et al. | 81/165 |
| 2,869,409 | A | | 1/1959 | Swanstrom et al. | 81/165 |
| 2,905,037 | A | | 9/1959 | Coslow | 81/165 |
| 3,093,019 | A | | 6/1963 | Bohnet | 81/166 |
| 3,354,755 | A | | 11/1967 | Legrande | 81/314 |
| 3,363,490 | A | | 1/1968 | Maichen | 81/77 |
| 3,376,766 | A | | 4/1968 | Vienat | 81/138 |
| 3,376,767 | A | | 4/1968 | O'Quinn | 81/145 |
| 3,541,899 | A | | 11/1970 | Tanner | 81/165 |

(Continued)

*Primary Examiner* — Hadi Shakeri
(74) *Attorney, Agent, or Firm* — MacCord Mason PLLC

(57) ABSTRACT

An adjustable wrench having a fixed jaw and a movable jaw is shown and described. In one example, a wrench can be set to at least one predetermined opening using a removable pin.

16 Claims, 7 Drawing Sheets

(56) References Cited

U.S. PATENT DOCUMENTS

| | | | | |
|---|---|---|---|---|
| 3,817,128 | A | 6/1974 | Evans | 81/145 |
| 3,868,875 | A | 3/1975 | Evans | 81/158 |
| 3,955,450 | A | 5/1976 | Evans | 81/170 |
| 3,968,708 | A | 7/1976 | Ingersoll | 81/157 |
| 3,983,768 | A | 10/1976 | Smith | 81/130 R |
| 4,011,778 | A | 3/1977 | Delin | 81/186 |
| 4,012,971 | A | 3/1977 | Zeyher | 81/170 |
| 4,028,969 | A | 6/1977 | Politte | 81/146 |
| 4,028,970 | A | 6/1977 | Pelczar | 81/165 |
| 4,046,034 | A | 9/1977 | Flewelling | 81/165 |
| 4,084,455 | A | 4/1978 | Budrose | 81/150 |
| 4,094,216 | A | 6/1978 | Jackson | 81/156 |
| 4,106,372 | A | 8/1978 | Miller | 81/143 |
| 4,122,569 | A | 10/1978 | Hitchcock | 7/134 |
| 4,147,077 | A | 4/1979 | Tasato | 81/367 |
| 4,151,763 | A | 5/1979 | Colvin | 81/77 |
| 4,156,368 | A | 5/1979 | Jackson | 74/424.8 A |
| 4,167,882 | A | 9/1979 | Siwersson | 81/186 |
| 4,234,987 | A | 11/1980 | Charette | 7/139 |
| 4,235,134 | A | 11/1980 | McLendon | 81/91 C |
| 4,237,756 | A | 12/1980 | Maclay | 81/185 |
| 4,281,568 | A | 8/1981 | Martinmaas | 81/134 |
| 4,287,795 | A | 9/1981 | Curtiss | 81/57.66 |
| 4,311,070 | A | 1/1982 | Whiteford | 81/77 |
| 4,324,160 | A | 4/1982 | Maclay | 81/185 |
| 4,325,275 | A | 4/1982 | Colvin | 81/77 |
| 4,326,436 | A | 4/1982 | McGraw | 81/165 |
| 4,333,366 | A | 6/1982 | Hurtig | 81/170 |
| 4,344,339 | A | 8/1982 | Penner | 81/157 |
| 4,350,063 | A | 9/1982 | Koehler | 81/64 |
| D271,274 | S | 11/1983 | Tasato | D08/23 |
| 4,432,256 | A | 2/1984 | Aparicio, Jr. | 81/57.39 |
| 4,446,764 | A | 5/1984 | Sievers | 81/170 |
| 4,454,791 | A | 6/1984 | Seward, III | 81/133 |
| 4,472,986 | A | 9/1984 | Gottlieb | 81/157 |
| D276,123 | S | 10/1984 | Pyles | D08/17 |
| 4,478,114 | A | 10/1984 | Arena | 81/363 |
| 4,488,461 | A | 12/1984 | Hurtig | 81/98 |
| 4,512,221 | A | 4/1985 | Picone | 81/170 |
| 4,513,642 | A | 4/1985 | Castner, Sr. | 81/53 R |
| 4,520,699 | A | 6/1985 | Jeremic | 81/166 |
| 4,534,246 | A | 8/1985 | McNulty | 81/111 |
| 4,552,039 | A | 11/1985 | Fisher | 81/64 |
| 4,593,585 | A | 6/1986 | Hurtig | 81/98 |
| 4,598,615 | A | 7/1986 | Tate | 81/64 |
| 4,602,533 | A | 7/1986 | Dunn | 81/134 |
| 4,653,357 | A | 3/1987 | Carlmark | 81/133 |
| 4,676,126 | A | 6/1987 | Polastri | 81/176.3 |
| D292,062 | S | 9/1987 | Doman | D08/22 |
| 4,694,711 | A | 9/1987 | Yang | 81/57.5 |
| 4,706,528 | A | 11/1987 | Inoue | 81/179 |
| 4,735,121 | A | 4/1988 | Coulson | 81/129 |
| 4,753,141 | A | 6/1988 | Hamrick | 81/166 |
| 4,766,786 | A | 8/1988 | Jeremic | 81/129 |
| 4,833,949 | A | 5/1989 | Piperkovski | 81/127 |
| 4,838,132 | A | 6/1989 | Pyles | 81/111 |
| 4,843,926 | A | 7/1989 | Bond | 81/185 |
| 4,864,901 | A | 9/1989 | Le Duc | 81/163 |
| D304,669 | S | 11/1989 | Boyd | D08/22 |
| 4,898,194 | A | 2/1990 | Einspahr | 132/251 |
| 4,903,556 | A | 2/1990 | Spirov | 81/149 |
| 4,903,557 | A | 2/1990 | Jeremic | 81/166 |
| 4,905,556 | A | 3/1990 | Haack et al. | 83/639.5 |
| 4,909,107 | A | 3/1990 | Jeremic | 81/166 |
| 4,913,668 | A | 4/1990 | Chamberlain | 439/755 |
| 4,916,987 | A | 4/1990 | Le Duc | 81/77 |
| 4,967,613 | A | 11/1990 | Cone | 81/166 |
| D313,925 | S | 1/1991 | Cone | D08/22 |
| 4,995,297 | A | 2/1991 | Richards | 81/126 |
| 5,016,503 | A | 5/1991 | Morton | 81/127 |
| 5,040,439 | A | 8/1991 | Chapman | 81/65.2 |
| 5,048,380 | A | 9/1991 | Caldwell | 81/165 |
| D321,310 | S | 11/1991 | Toyoshima | D08/22 |
| D321,311 | S | 11/1991 | Toyoshima | D08/22 |
| D322,545 | S | 12/1991 | Cone | D08/22 |
| 5,094,132 | A | 3/1992 | Engel | 81/363 |
| 5,095,782 | A | 3/1992 | Galea | 81/127 |
| 5,103,697 | A | 4/1992 | Masbaum | 81/154 |
| D326,037 | S | 5/1992 | Murayama | D08/22 |
| D326,038 | S | 5/1992 | Murayama | D08/22 |
| 5,136,902 | A | 8/1992 | Ma | 81/119 |
| 5,152,198 | A | 10/1992 | Schmitz, Jr. | 81/145 |
| 5,152,199 | A | 10/1992 | Lain | 81/177.2 |
| 5,154,103 | A | 10/1992 | Lewis, Jr. | 81/165 |
| 5,159,103 | A | 10/1992 | Boigegrain | 560/45 |
| 5,207,129 | A | 5/1993 | Fossella | 81/63.2 |
| 5,209,144 | A | 5/1993 | Lu Guoji | 81/165 |
| 5,222,419 | A | 6/1993 | Spector | 81/165 |
| 5,230,264 | A | 7/1993 | Kindling | 81/151 |
| D337,927 | S | 8/1993 | Roenbaugh | D08/22 |
| 5,231,904 | A | 8/1993 | Masbaum | 81/126 |
| 5,237,715 | A | 8/1993 | Bane, III | 7/139 |
| 5,239,898 | A | 8/1993 | Douglas | 81/165 |
| 5,249,490 | A | 10/1993 | Kennel | 81/405 |
| 5,280,659 | A | 1/1994 | Park | 7/128 |
| 5,301,576 | A | 4/1994 | Nye | 81/165 |
| 5,305,667 | A | 4/1994 | Caballero | 81/165 |
| 5,305,670 | A | 4/1994 | Fossella | 81/63.2 |
| 5,331,868 | A | 7/1994 | Elmore | 81/165 |
| 5,331,869 | A | 7/1994 | Webb | 81/177.1 |
| 5,345,636 | A | 9/1994 | Lamons | 7/139 |
| D352,215 | S | 11/1994 | Starck | D08/22 |
| 5,408,904 | A | 4/1995 | Neff | 81/60 |
| 5,415,064 | A | 5/1995 | Chang | 81/166 |
| 5,448,931 | A | 9/1995 | Fossella | 81/63.2 |
| D367,412 | S | 2/1996 | Baldwin | D08/22 |
| 5,535,650 | A | 7/1996 | McNatt | 81/361 |
| 5,540,125 | A | 7/1996 | Haskell | 81/170 |
| 5,551,322 | A | 9/1996 | Mikic | 81/186 |
| 5,557,993 | A | 9/1996 | Austin | 81/165 |
| 5,579,667 | A | 12/1996 | Kim | 81/185.1 |
| 5,595,098 | A | 1/1997 | Malkin | 81/165 |
| 5,644,957 | A | 7/1997 | Gustafson | 81/165 |
| 5,644,960 | A | 7/1997 | O'Brien | 81/363 |
| D385,165 | S | 10/1997 | Suksi | D08/22 |
| D385,760 | S | 11/1997 | McCann | D08/22 |
| 5,685,205 | A | 11/1997 | Suksi | 81/77 |
| 5,685,206 | A | 11/1997 | Ma | 81/77 |
| D388,294 | S | 12/1997 | Kim | D08/22 |
| D388,295 | S | 12/1997 | Kim | D08/22 |
| 5,697,166 | A | 12/1997 | Hommel | 33/758 |
| 5,809,852 | A | 9/1998 | Haskell | 81/129 |
| 5,819,608 | A | 10/1998 | Hsieh | 81/150 |
| 5,860,336 | A | 1/1999 | Chen | 81/170 |
| 5,862,722 | A | 1/1999 | Cislo | 81/164 |
| 5,870,932 | A | 2/1999 | Brooke | 81/177.8 |
| 5,896,790 | A | 4/1999 | Chiang | 881/98 |
| 5,941,142 | A | 8/1999 | Janson | 81/165 |
| D414,996 | S | 10/1999 | Macor | D08/22 |
| 5,970,553 | A | 10/1999 | Lin | 7/143 |
| 5,996,446 | A | 12/1999 | Lee | 81/128 |
| 6,000,301 | A | 12/1999 | Hillinger | 81/166 |
| 6,016,726 | A | 1/2000 | Wright | 81/177.7 |
| 6,026,714 | A | 2/2000 | Chang | 81/100 |
| 6,029,548 | A | 2/2000 | Hsieh | 81/166 |
| 6,076,435 | A | 6/2000 | White, Sr. | 81/176.2 |
| 6,079,300 | A | 6/2000 | Hu | 81/165 |
| 6,089,129 | A | 7/2000 | Huang | 81/133 |
| 6,089,130 | A | 7/2000 | Wu | 81/170 |
| 6,098,505 | A | 8/2000 | Chang | 81/166 |
| 6,098,506 | A | 8/2000 | Clegg | 81/170 |
| 6,116,121 | A | 9/2000 | Kitt, Jr. | 81/170 |
| D432,879 | S | 10/2000 | Loyaute | D08/22 |
| 6,125,724 | A | 10/2000 | Murphy et al. | 81/133 |
| 6,128,980 | A | 10/2000 | Hu | 81/170 |
| 6,151,996 | A | 11/2000 | Whiteford | 81/127 |
| 6,186,034 | B1 | 2/2001 | Lamons | 81/177.9 |
| 6,202,516 | B1 | 3/2001 | Kim | 81/179 |
| 6,205,892 | B1 | 3/2001 | Davidson | 81/128 |
| D445,656 | S | 7/2001 | Ranieri | D08/22 |
| 6,257,100 | B1 | 7/2001 | Tai | 81/142 |
| 6,267,029 | B1 | 7/2001 | Hermann | 81/170 |
| D447,049 | S | 8/2001 | Vandervort | D09/310 |
| 6,276,241 | B1 | 8/2001 | Cornog | 81/170 |

(56) References Cited

U.S. PATENT DOCUMENTS

| | | | | |
|---|---|---|---|---|
| 6,279,429 | B1 | 8/2001 | Boyer | 81/159 |
| 6,295,898 | B1 | 10/2001 | Hsieh | 81/177.8 |
| 6,305,249 | B1 | 10/2001 | Wang | 81/63 |
| 6,334,693 | B1 | 1/2002 | Lee | 62/119 |
| 6,336,384 | B1 | 1/2002 | Huang | 81/165 |
| 6,341,544 | B1 | 1/2002 | Falzone | 81/128 |
| 6,343,530 | B1 | 2/2002 | Huang | 81/57.39 |
| 6,345,555 | B1 | 2/2002 | Huang | 81/157 |
| 6,363,561 | B1 | 4/2002 | Chang | 7/142 |
| 6,370,989 | B1 | 4/2002 | Baker | 81/165 |
| 6,382,056 | B1 | 5/2002 | Wu | 81/165 |
| 6,386,073 | B1 | 5/2002 | Chen | 818/99 |
| D461,381 | S | 8/2002 | Kramer | D08/22 |
| 6,431,033 | B1 | 8/2002 | Cheng | 81/133 |
| D463,233 | S | 9/2002 | Salazar | 8/22 |
| 6,470,773 | B1 | 10/2002 | Wu | 81/165 |
| D465,706 | S | 11/2002 | Ravaillault | 8/22 |
| 6,484,610 | B1 | 11/2002 | Macor | 81/165 |
| 6,557,442 | B1 | 5/2003 | Owoc | 81/177.9 |
| 6,568,301 | B2 | 5/2003 | Huang | 81/165 |
| D478,794 | S | 8/2003 | Kramer | D08/22 |
| 6,615,694 | B1 | 9/2003 | Macor | 81/165 |
| 6,739,223 | B2 | 5/2004 | Wu | 81/179 |
| 6,748,826 | B2 | 6/2004 | Marks | 81/165 |
| 6,748,827 | B2 | 6/2004 | Huang | 81/166 |
| 6,752,045 | B2 | 6/2004 | Badiali | 81/57.39 |
| 6,789,451 | B1 | 9/2004 | Wu | 1/157 |
| 6,834,569 | B2 | 12/2004 | Wang | 81/133 |
| 6,848,242 | B2 | 2/2005 | Chang et al. | 54/9 |
| 6,848,342 | B2 | 2/2005 | Bergfeld, III | 81/153 |
| 6,851,338 | B2 | 2/2005 | Wu | 1/170 |
| 6,854,265 | B2 | 2/2005 | Saito et al. | 60/295 |
| 6,928,905 | B1 | 8/2005 | Hsien | 81/165 |
| 6,951,157 | B1 | 10/2005 | Tedrick | 81/165 |
| 6,966,242 | B2 | 11/2005 | Picone | 81/165 |
| 6,971,284 | B2 | 12/2005 | Owoc | 81/58.2 |
| 6,983,676 | B1 | 1/2006 | Huang | 81/145 |
| 7,013,763 | B2 | 3/2006 | Hsien | 81/165 |
| 7,017,454 | B2 | 3/2006 | Chang | 81/176.3 |
| 7,036,952 | B2 | 5/2006 | Zirk | 362/119 |
| 7,059,221 | B2 | 6/2006 | Simon | 81/164 |
| D524,126 | S | 7/2006 | Beckwith | D08/22 |
| 7,096,767 | B2 | 8/2006 | Sherburne | 81/145 |
| 7,100,478 | B2 | 9/2006 | Davis | 81/176.15 |
| 7,114,824 | B2 | 10/2006 | Picone | 362/119 |
| 7,117,768 | B1 | 10/2006 | Stoeppelwerth | 81/133 |
| 7,131,355 | B2 | 11/2006 | Williams | 81/151 |
| 7,137,321 | B1 | 11/2006 | Huang | 81/126 |
| 7,140,276 | B1 | 11/2006 | Jeng | 81/150 |
| 7,156,001 | B2 | 1/2007 | Cluthe | 81/128 |
| 7,174,813 | B2 | 2/2007 | Davidson | 81/155 |
| 7,228,765 | B1 | 6/2007 | Wu | 81/165 |
| D546,148 | S | 7/2007 | Becker | D08/22 |
| D547,149 | S | 7/2007 | Wu | D08/22 |
| 7,246,543 | B1 | 7/2007 | Patti | 81/124.5 |
| 7,246,593 | B2 | 7/2007 | Murphy | 123/184.57 |
| D548,553 | S | 8/2007 | Hsieh | D08/22 |
| D549,533 | S | 8/2007 | Pond | D08/22 |
| 7,275,465 | B2 | 10/2007 | Maznicki | 81/436 |
| 7,284,465 | B1 | 10/2007 | Chen | 81/165 |
| 7,299,722 | B2 | 11/2007 | Lu | 81/165 |
| 7,305,909 | B2 | 12/2007 | Bollinger | 81/185 |
| 7,334,502 | B1 | 2/2008 | Durkee | 81/20 |
| 7,347,125 | B1 | 3/2008 | Juieng | 81/129.5 |
| 7,377,198 | B2 | 5/2008 | Picone | 81/57.13 |
| 7,415,911 | B2 | 8/2008 | Cole | 81/177.8 |
| 7,424,838 | B2 | 9/2008 | Li | 81/165 |
| D580,242 | S | 11/2008 | Robinson | D02/22 |
| D580,243 | S | 11/2008 | Robinson | D08/22 |
| D597,806 | S | 8/2009 | Davidson | D08/22 |
| D597,807 | S | 8/2009 | Wu | 8/22 |
| 7,591,208 | B2 | 9/2009 | Cole | 81/177.8 |
| 7,600,449 | B2 | 10/2009 | Huang | 81/57.14 |
| 7,607,373 | B2 | 10/2009 | Anderson | 81/129 |
| D604,130 | S | 11/2009 | Macor | D08/22 |
| 7,661,167 | B2 | 2/2010 | Wu | 7/139 |
| D610,895 | S | 3/2010 | Garcia | D08/107 |

* cited by examiner

ADJUSTABLE WRENCH

RELATED APPLICATIONS

The instant application claims the priority of U.S. Patent Application No. 61/390,676 filed 7 Oct. 2010.

FIELD OF DISCLOSURE

The current disclosure relates generally to wrenches, and more particularly to adjustable wrenches having calibrated adjustment.

BACKGROUND

FIG. 1 illustrates an example of a typical adjustable wrench known in the art. Oftentimes these types of wrenches are referred to as adjustable crescent wrenches. Applicant believes such crescent wrenches suffer from a variety of problems including at least one of difficulty to adjust, lack of precision, lack of stability after adjustment, excessive play of the movable jaw, etc.

The current disclosure is directed to wrenches that overcome at least one of the above-mentioned, or additional problems.

SUMMARY

The current disclosure is directed to wrench having a fixed jaw and a movable jaw. The wrench can be set to a predetermined opening using a removable pin. Using Applicant's configuration, wrenches can be quickly and accurately set at predetermined locations without the need for threadable adjustment, e.g. a worm drive.

The above summary was intended to summarize certain embodiments of the present disclosure. Systems, methods and compositions will be set forth in more detail in the figures and detailed description below. It will be apparent, however, that the detailed description is not intended to limit the present invention.

DETAILED DESCRIPTION OF EXEMPLARY EMBODIMENTS

Figure 1:
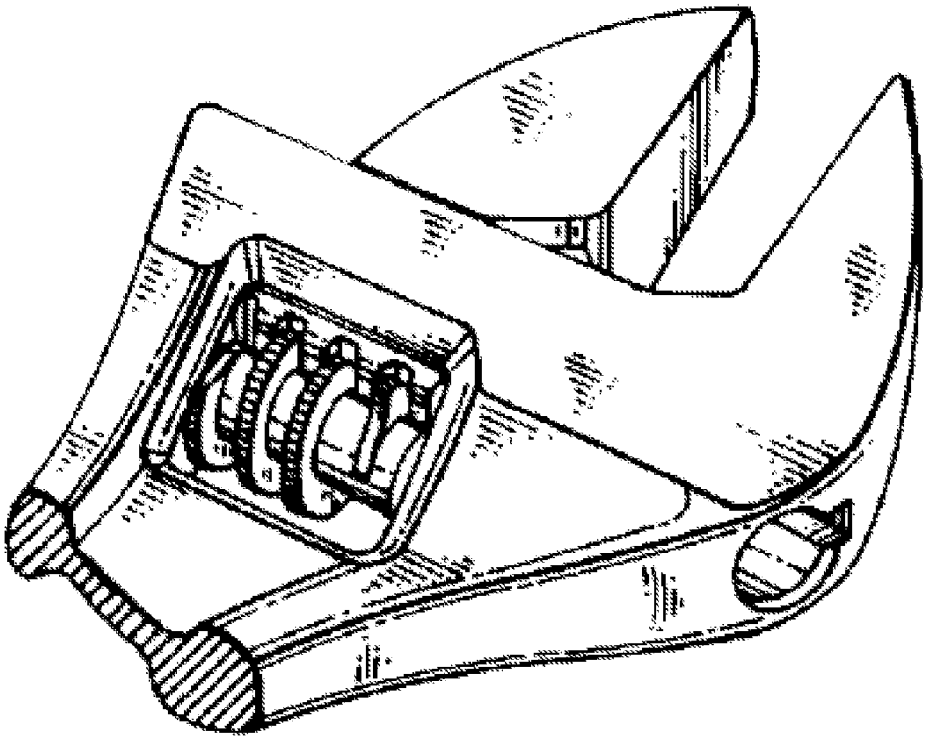
FIG. 1 PRIOR ART
FIG. 1 shows an example of a known wrench.
Figure 2:
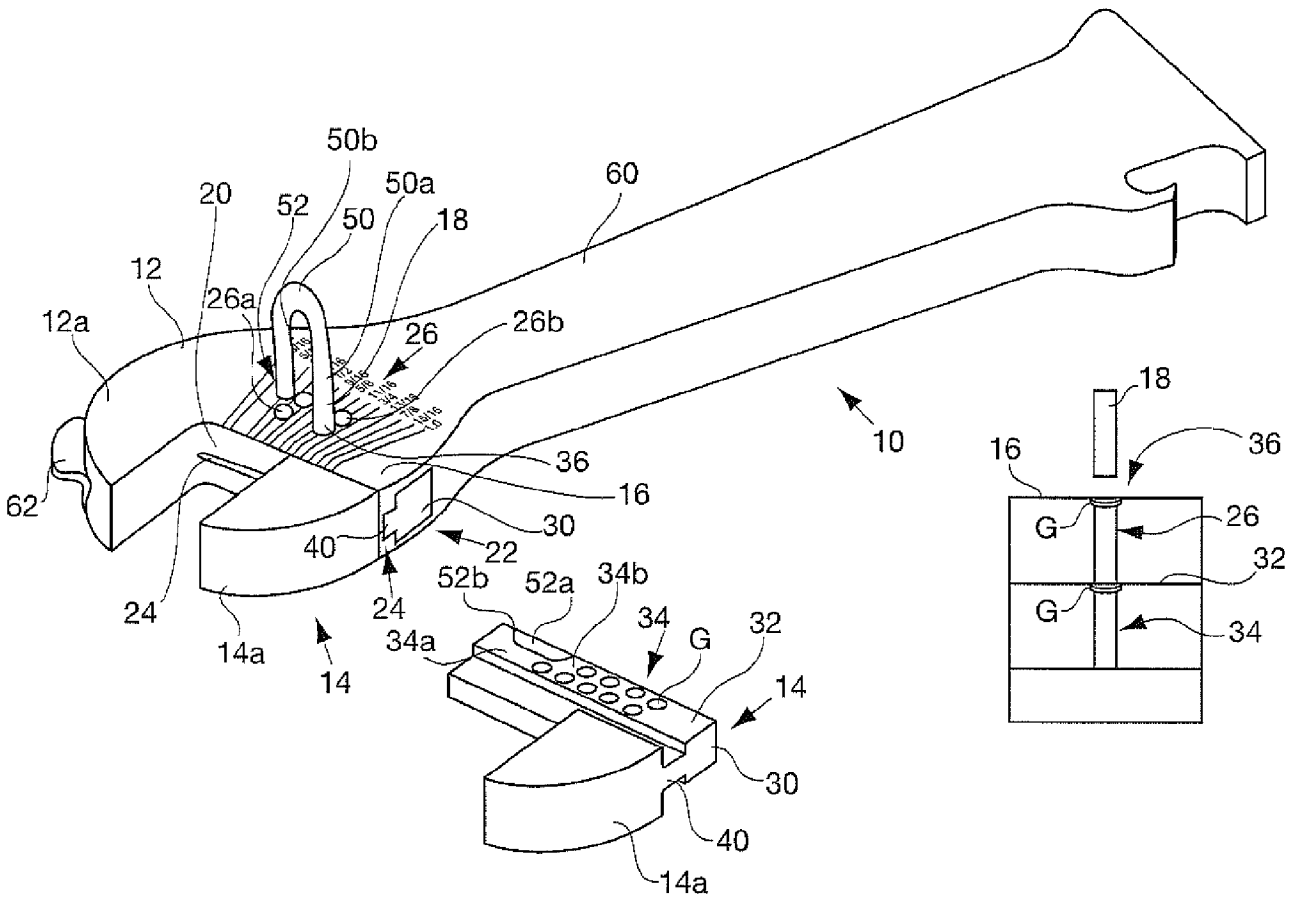
FIG. 2 illustrates a perspective view of a wrench according to one example.
Figure 3A:
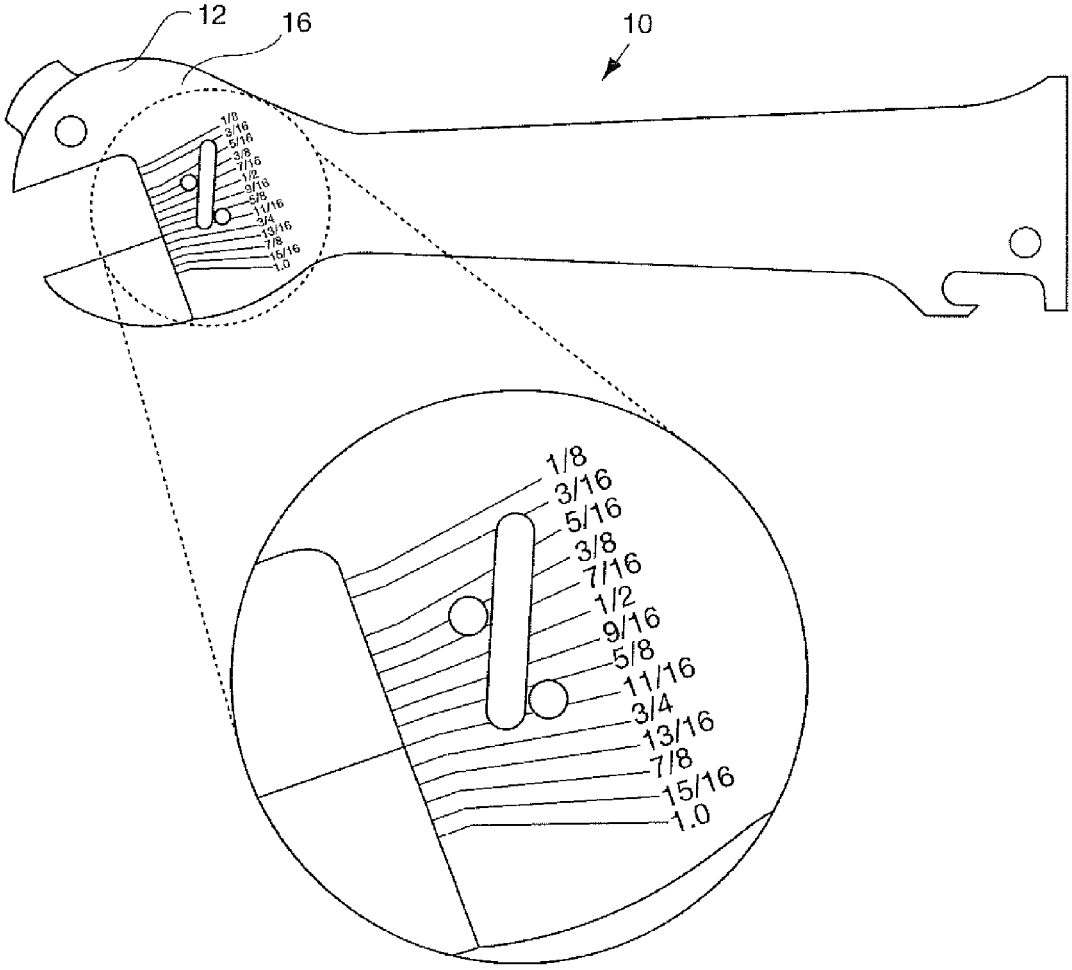
FIG. 3*a* illustrates a pin side view of a wrench as disclosed herein.
Figure 3B:
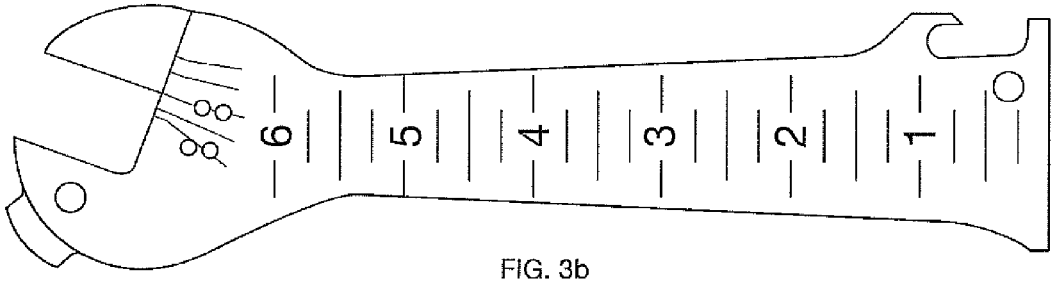
FIG. 3*b* illustrates a second side view of the wrench of FIG. 3*a*.
Figure 3C:
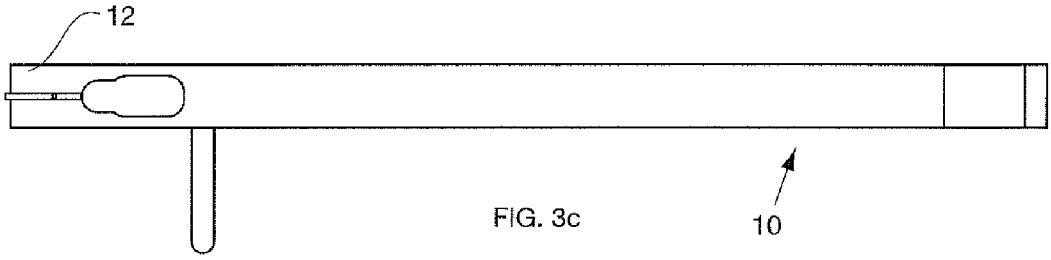
FIG. 3*c* illustrates a front view of the wrench of FIG. 3*a*.
Figure 3D:
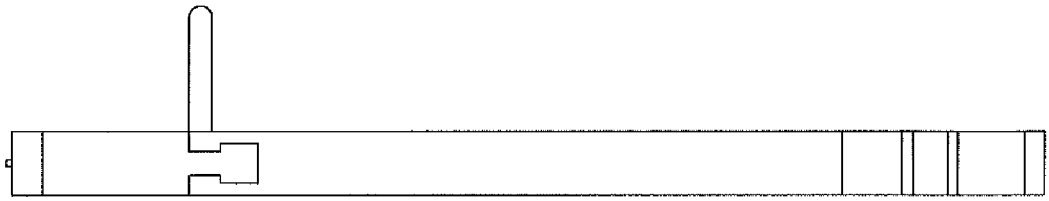
FIG. 3*d* illustrates a back view of the wrench of FIG. 3*a*.
Figure 3E:
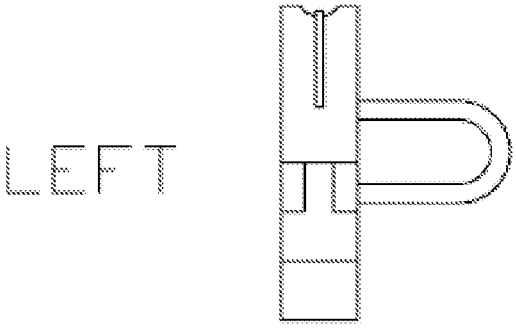
FIG. 3*e* illustrates a left side view of the wrench of FIG. 3*a*.
Figure 3F:
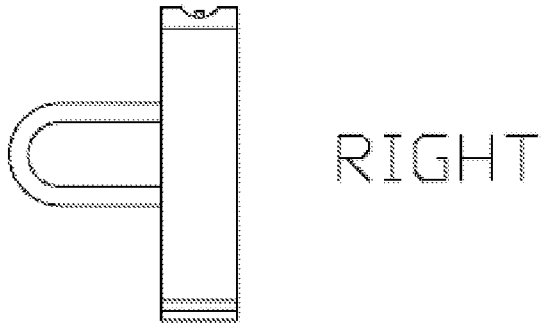
FIG. 3*f* illustrates a right side view of the wrench of FIG. 3*a*.
Figure 4:
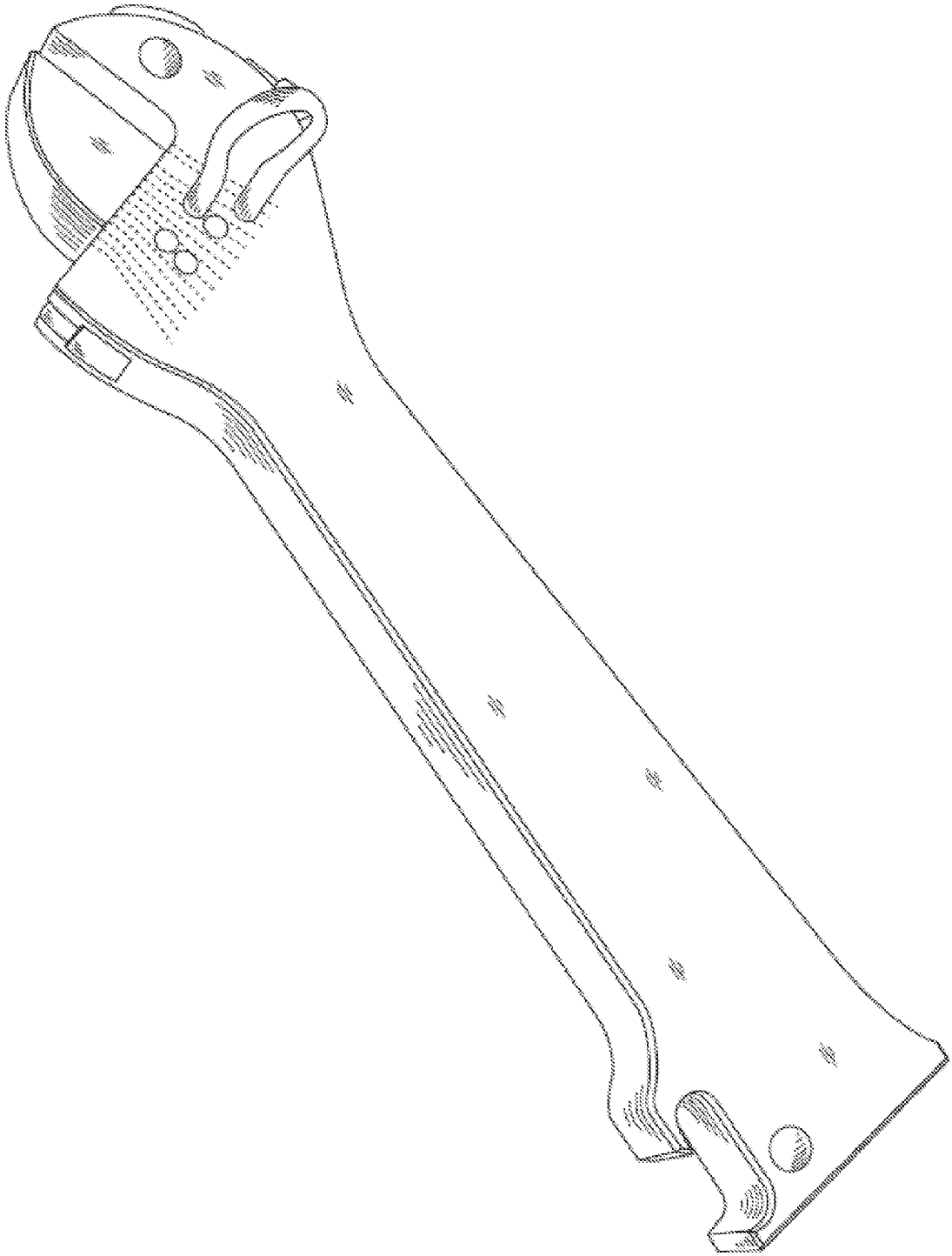
FIG. 4 shows a perspective view of a wrench similar to the wrench shown in FIG. 2 in a different configuration.
Figure 5:
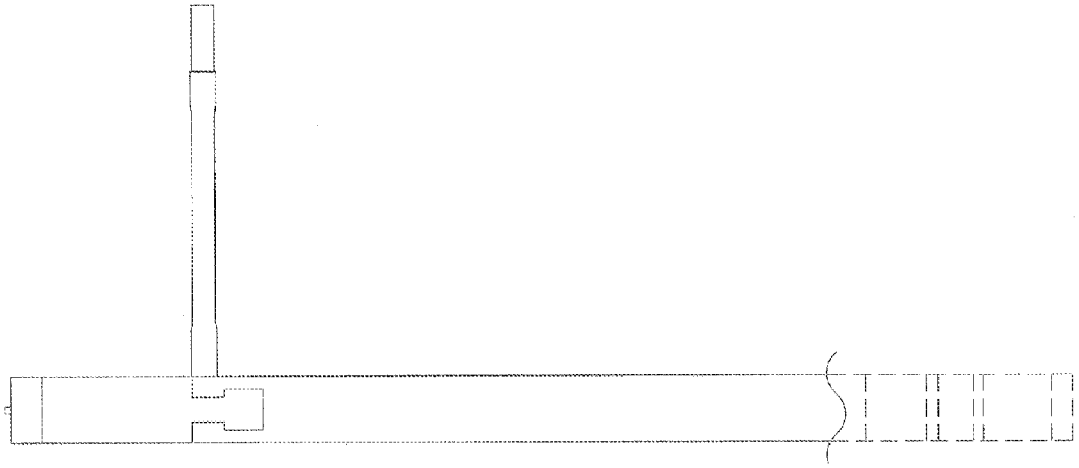
FIG. 5 illustrates a side view of a wrench, having the removable pin removed.

FIG. 2 illustrates a perspective view of wrench 10, one example of a wrench as disclosed herein. FIG. 3*a* illustrates a pin side view of wrench 10. FIG. 3*b* illustrates a second side view of wrench 10. FIG. 3*c* illustrates a front view of wrench 10. FIG. 3*d* illustrates a back view of wrench 10. FIG. 3*e* illustrates a left side view of wrench 10. FIG. 3*f* illustrates a right side view of wrench 10.

Referring primarily to FIG. 2, wrench 10 includes head 12, movable member (MM) 14, and removable pin 18. Head 12 includes a fixed jaw 12*a* extending from the head. MM 14 is configured to engage with head 12 and includes a movable jaw 14*a*. Pin 18 allows wrench 10 to be securely adjusted with a predetermined wrench opening between the fixed jaw and the movable jaw. MM 14 is also shown disengaged from head 12 for illustration of internal parts.

Head construction may vary from example to example. In this example, head 12 includes a first-pin-side (1PS) 16, a slide 20, and a channel 22. Slide 20 is defined by the head and provides a surface along which movable jaw 14*a* travels. Slide 20 will typically be positioned adjacent to the fixed jaw and extend toward the back of the wrench.

Channel 22 is defined in the head and extends through the head beneath the slide and the fixed jaw, thereby providing an area in which at least a portion of the movable member may be received. Head 12 also includes slot 24, which is defined through slide 20 and is in communication with, e.g. extends through to, channel 22.

Head 12 includes a plurality of first-pin-holes (1PH) 26 defined in the in the 1PS. The plurality of 1PH are in communication with channel 22.

In addition to movable jaw 14*a*, MM 14 includes a body 30, a second-pin-side (2PS) 32, and a neck 40. 2PS 32 is configured to be placed proximal to 1PS and to abut 1PS 16 along the internal side of 1PS 16. Body 30 is configured to be slidably received by the head's channel 22. Neck 40 extends upward from body 30 and connects to jaw 14*a*. Neck 30 is configured to slide within slot 24.

MM 14 also includes a plurality of second-pin-holes (2PH) 34 defined in 2PS 32. Typically, 2PS 32 will be planner, as illustrated, to allow for a flush abutment with 1PS. The planner configuration may also be used to facilitate placement of more 2PH. Other examples include other shapes.

At least one of 2PH 34 is alignable with at least one of the 1PH 26, thereby creating a lock-channel (LC) 36. In this illustration, LC 36 has received pin 18, thereby creating a secure and stable predetermined wrench opening. FIG. 2 also includes a small cutaway illustrating an LC example.

In many examples, the wrench will be configured to allow for a variety of LCs. For example, at least one of the 1PH may be alignable with at least two of the 2PH, thereby creating a plurality predetermined wrench openings. At least one of the 1PH may be alignable with at least three of the 2PH, thereby creating a plurality predetermined wrench openings. At least one of the 1PH may be alignable with at least four of the 2PH, thereby creating a plurality predetermined wrench openings. At least one of the 1PH may be alignable with at least five of the 2PH, thereby creating a plurality predetermined wrench openings. At least two of the 1PH may be alignable with at least two of the 2PH, thereby creating a plurality predetermined wrench openings. At least three of the 1PH may be alignable with at least three of the 2PH, thereby creating a plurality predetermined wrench openings.

In many examples, the 1PH will include an upper plurality of pin holes and a lower plurality of pin holes, and the 2PH will include an upper plurality of pin holes and a lower plurality of pin holes. In wrench 10, for example, 1PH 26 include upper plurality 26*a* and lower plurality 26*b*, and 2PH will include upper plurality 34*a* and lower plurality 34*b*. In these types of examples, at least one of the 1PH's upper plurality of pin holes may be alignable with at least two of the 2PH's upper plurality of pin holes, and at least one of the 1PH's lower plurality of pin holes may be alignable with at least two of the 2PH's lower plurality of pin holes, thereby creating a plurality predetermined wrench openings. In other examples, at least one of the 1PH's upper plurality of pin holes may be alignable with at least two of the 2PH's upper plurality of pin holes, and at least one of the 1PH's lower plurality of pin holes may be alignable with at least two of the 2PH's lower plurality of pin holes.

Using examples described above, wrenches can be constructed to have a variety of predetermined wrench openings. For example, 1PH and 2PH are arranged such that the predetermined wrench opening includes at least one opening size chosen from ⅛", 3/16", 5/16", ⅜", 7/16", ½", 9/16", ⅝", 11/16", ¾", 13/16", ⅞", 1/16" and 1". In another example, the 1PH and 2PH are arranged such that the predetermined wrench opening includes at least two opening sizes chosen from ⅛", 3/16", 5/16", ⅜", 7/16", ½, 9/16", ⅝", 11/16", ¾", 13/16", ⅞", 15/16" and 1". In another example, the 1PH and 2PH are arranged such that the predetermined wrench opening includes at least three opening sizes chosen from ⅛", 3/16", 5/16", ⅜", 7/16", ½', 9/16", ⅝", 11/16", ¾", 1 3/16", ⅞", 15/16" and 1". In another example, the 1PH and 2PH are arranged such that the predetermined wrench opening includes at least four opening sizes chosen from ⅛", 3/16", 5/16", ⅜", 7/16", ½", 9/16", ⅝", 11/16", ¾", 13/16", ⅞", 15/16" and 1". In another example, the 1PH and 2PH are arranged such that the predetermined wrench opening includes at least five opening sizes chosen from ⅛", 3/16", 5/16", ⅜", 7/16", ½", 9/16", ⅝", 11/16", ¾", 13/16", ⅞", 15/16" and 1". In another example, the 1PH and 2PH are arranged such that the predetermined wrench opening includes at least six opening sizes chosen from ⅛", 3/16", 5/16", ⅜", 7/16", ½", 9/16", ⅝", 11/16", ¾", 13/16", ⅞", 15/16" and 1". In another example, the 1PH and 2PH are arranged such that the predetermined wrench opening includes at least seven opening sizes chosen from ⅛", 3/16", 5/16", ⅜", 7/16", ½", 9/16", ⅝", 11/16". ¾", 13/16", ⅞", 15/16" and 1". Predetermined wrench openings may include metric sizes. For example, he 1PH and 2PH are arranged such that the predetermined wrench opening includes at least one, two, three, four, five, six, seven, eight, nine or more opening sizes chosen from 5.5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, 26 mm, 27 mm, 28 mm, 29 mm, 30 mm, 31 mm, 32 mm, 33 mm, 34 mm, 35 mm, 36 mm, 37 mm, 38 mm, 39 mm, 40 mm, 41 mm, etc. Predetermined wrench openings may also include AN sizes, e.g., at least one of 3, 4, 6, 8, and 10. In some examples, wrench heads may be labeled with predetermined opening sizes.

It should be readily apparent from the above description that the body of the movable member is not threadably adjusted as is the case with most known wrenches. Using any of the described configurations, Applicant's wrench and be quickly and precisely set to the desired predetermined position where it will remain with stability until another predetermined position is desired.

In many examples, wrenches will include a flexible connector connected at its first end to the removable pin and at its second end to a portion of the wrench. Such a configuration may be used, for example, to prevent the removable pin from being misplaced. Flexible connectors will typically have a length and flexibility sufficient to allow the removable pin to be inserted into at least one of the 1PH, more typically, to all of the 1PH. Wrench 10 includes flexible connector 50, which is connected at its first end 50*a* to pin 18. In this example, flexible connector 50 is a piece of shrink tubing that has been placed over a portion of pin 18, and shrunk to securely attach to pin 18. Other examples include other flexible connectors and methods of attachment, e.g., a chain or cord connected to an aperture of a removable pin.

In many examples, the wrench is configured to prevent the MM from unintentionally sliding out of the head when the removable pin is disengaged. For example, the 1PS may further define a locking-pin-hole (LPH) in communication with the channel and the body's 2PS may further define a locking-pin-groove (LPG) having a stop-wall. A locking-pin may be configured to be secured in the in the LPH and abut the LPG, wherein the interface between the locking-pin and the stop-wall prevents the MM's body from sliding out of the head's channel. The locking-pin may extend outwardly from the surface of the head and is connect to the second end of the flexible connector. For example, in FIG. 2, hole 52 is the LPH, and a locking pin has been positioned in hole 52 and is received by LPG 52*a* of MM 14. Stop-wall 52*b* abuts the locking-pin, thereby preventing MM 14 from becoming disengaged. Locking-pins may further be constructed to prevent the locking pin from being unintentionally removed from the LPH. For example the locking-pin may include a head having a larger diameter than the diameter of the LPH.

In some examples, MMs, heads, or both, may include gaskets G to help retain the removable pin or the locking pin. In one example, the gasket will have a non-expanded diameter that is smaller than the diameter of the pin, but large enough to allow the pin to be received by the gasket. The constriction created by the gasket will help retain the pin in the desired location.

Wrenches will typically also include a handle, e.g., handle 60, and may in many examples, include a dzus fastener tool, e.g., 62.

In many examples, wrenches as described herein will be constructed from aluminum, for example, to use with aluminum bolts or nuts, fittings, e.g., plumbing fittings, etc. Wrenches may however be constructed from other materials, e.g., steel.

Numerous characteristics and advantages have been set forth in the foregoing description, together with details of structure and function. The disclosure, however, is illustrative only, and changes may be made in detail, especially in matters of shape, size, and arrangement of parts. Further, the various examples are not intended to be mutually exclusive. As such, parts may be considered interchangeable, for example, unless such an interchange would render the example non-functional.

What is claimed is:

1. An adjustable wrench comprising a head having a first-pin-side;

a fixed jaw extending from the head;

a slide defined by the head and positioned adjacent to the fixed jaw;

a channel defined in the head, the channel extending through the head beneath the slide and the fixed jaw;

a slot defined through the slide and in communication with the channel;

a plurality of first-pin-holes defined in the first-pin-side, the plurality of first-pin-holes being in communication with the channel;

a movable member configured to engage with the head, the movable member comprising a body configured to be slidably received by the head's channel and having a second-pin-side configured to abut the first-pin-side, wherein the second-pin-side defines a plurality of second-pin-holes, and wherein at least one of the second-pin-holes is alignable with at least one of the first-pin-holes, thereby creating a lock-channel, and a movable jaw positionable along the slide, wherein the movable jaw is attached to the body by a neck, the neck being configured to slide within the head's slot;

a removable pin configured to extend into the lock-channel and thereby create a predetermined wrench opening between the fixed jaw and the movable jaw; and a flexible connector connected at its first end to the removable pin, wherein the flexible connector has a length and flexibility sufficient to allow the removable pin to be inserted into at least one of the first-pin-holes, and wherein the head's first-pin-side further defines a locking-pin-hole in communication with the channel, wherein the body's second-pin-side further defines a locking-pin-groove having a stop-wall, and wherein the wrench further includes a locking-pin connected to the second end of the flexible connector, the locking-pin configured to be secured in the locking-pin-hole and abut the locking-pin-groove, wherein the interface between the locking-pin and the stop-wall prevents the movable member's body from sliding out of the head's channel.

2. The wrench of claim 1, wherein at least one of the first-pin-holes is alignable with a number of second-pin-holes chosen from at least one of: at least two of the second-pin-holes, at least three of the second-pin-holes, at least four of the second-pin-holes, and at least five of the second-pin-holes, thereby creating a plurality predetermined wrench openings.

3. The wrench of claim 1, wherein at least two of the first-pin-holes are alignable with a number of second-pin-holes chosen from at least one of: at least two of the second-pin-holes, at least three of the second-pin-holes, and least four of the second-pin-holes, thereby creating a plurality predetermined wrench openings.

4. The wrench of claim 1, wherein the first-pin-holes include an upper plurality of pin holes and a lower plurality of pin holes, and wherein the second-pin-holes include an upper plurality of pin holes and a lower plurality of pin holes.

5. The wrench of claim 4, wherein at least one of the first-pin-holes' upper plurality of pin holes is alignable with at least two of the second-pin-holes' upper plurality of pin holes, and wherein at least one of the first-pin-holes' lower plurality of pin holes is alignable with at least two of the second-pin-holes' lower plurality of pin holes, thereby creating a plurality predetermined wrench openings.

6. The wrench of claim 5, wherein at least two of the first-pin-holes' upper plurality of pin holes are alignable with at least two of the second-pin-holes' tipper plurality of pin holes, and wherein at least two of the first-pin-holes' lower plurality of pin holes are alignable with at least two of the second-pin-holes' lower plurality of pin holes, thereby creating a plurality predetermined wrench openings.

7. The wrench of claim 1, wherein the first-pin-holes and second-pin-holes are arranged such that the predetermined wrench opening includes a number of opening sizes chosen from at least one of 1/8", 3/16", 5/16", 3/8", 7/16", 1/2", 9/16", 5/8", 11/16", 3/4", 13/16", 7/8", 15/16" and 1";

at least two of 1/8", 3/16", 5/16", 3/8", 7/16", 1/2", 9/16", 5/8", 11/16", 3/4", 13/16", 7/8", 15/16" and 1";

at least three of 1/8", 3/16", 5/16", 3/8", 7/16", 1/2", 9/16", 5/8", 11/16", 3/4", 13/16", 7/8", 15/16" and 1";

at least four of 1/8", 3/16", 5/16", 3/8", 7/16", 1/2", 9/16", 5/8", 11/16", 3/4", 13/16", 7/8", 15/16" and 1";

at least five of 1/8", 3/16", 5/16", 3/8", 7/16", 1/2", 9/16", 5/8", 11/16", 3/4", 13/16", 7/8", 15/16" and 1";

at least six of 1/8", 3/16", 5/16", 3/8", 7/16",1/2", 9/16", 5/8", 11/16", 3/4", 13/16", 7/8", 15/16" and 1";

at least seven of 1/8", 3/16", 5/16", 3/8", 7/16", 1/2", 9/16", 5/8", 11/16", 3/4", 13/16", 7/8", 15/16" and 1".

8. The wrench of claim 1, wherein the locking-pin extends outwardly from the surface of the head.

9. The wrench of claim 1, wherein the body is not threadably adjusted.

10. An adjustable wrench comprising a head having a first-pin-side;

a fixed jaw extending from the head;

a slide defined by the head and positioned adjacent to the fixed jaw;

a channel defined in the head, the channel extending through the head beneath the slide and the fixed jaw;

a slot defined through the slide and in communication with the channel;

at least three first-pin-holes defined in the first-pin-side, the three first-pin-holes being in communication with the channel;

a movable member configured to engage with the head, the movable member comprising a body configured to be slidably received by the head's channel and having a second-pin-side configured to abut the first-pin-side, wherein the second-pin-side defines at least seven second-pin-holes, and wherein each of the seven second-pin-holes are alignable with at least two of the three first-pin-holes, thereby creating a plurality of lock-channels, and a movable jaw positionable along the slide, wherein the movable jaw is attached to the body by a neck, the neck being configured to slide within the head's slot; and a removable pin configured to extend into each of the plurality of lock-channels and thereby create a plurality of predetermined wrench opening between the fixed jaw and the movable jaw, the predetermined wrench openings including at least seven opening sizes chosen from 1/8", 3/16", 5/16", 3/8", 7/16", 1/2", 9/16", 5/8", 11/16", 3/4", 13/16", 7/8", 15/16" and 1";

wherein the head's first-pin-side further defines a locking-pin-hole in communication with the channel, wherein the body's second-pin-side further defines a locking-pin-groove having a stop-wall, and wherein the wrench further includes a locking-pin configured to be secured in the locking-pin-hole and abut the locking-pin-groove, wherein the interface between the locking-pin and the stop-wall prevent the movable member's body from sliding out of the head's channel.

11. The wrench of claim 10, further including a flexible connector connected at its first end to the removable pin and at its second end to the locking-pin, wherein the flexible connector has a length and flexibility sufficient to allow the removable pin to be inserted into the at least three first-pin-holes.

12. The wrench of claim 10, wherein the locking-pin extends outwardly from the surface of the head.

13. The wrench of claim 10, wherein the body is not threadably adjusted.

14. An adjustable wrench comprising a head having a first-pin-side defining a plurality of first-pin-holes;

a movable member configured to engage with the head, the movable member comprising a body configured to be slidably received by the head and having a second-pin-side configured to abut the first-pin-side, wherein the second-pin-side defines a plurality of second-pin-holes, and wherein at least one of the second-pin-holes is alignable with at least one of the first-pin-holes, thereby creating a lock-channel; and a removable pin configured to extend into the lock-channel and thereby create a predetermined wrench opening between the fixed jaw and the movable jaw, and wherein the head's first-pin-side further defines a locking-pin-hole, wherein the body's second-pin-side further defines a locking-pin-groove having a stop-wall, and wherein the wrench further includes a locking-pin connected to the second end of a flexible connector, wherein the locking-pin is configured to be secured in the locking-pin-hole and abut the locking-pin-groove, wherein the interface between the locking-pin and the stop-wall prevents the movable member's body from sliding out of the head.

15. The wrench of claim 14, wherein the first-pin-holes and second-pin-holes are arranged such that the predetermined wrench opening includes at least four opening sizes chosen from 1/8", 3/16", 5/16", 3/8", 7/16", 1/2", 9/16", 5/8", 11/16", 3/4", 13/16", 7/8", 15/16" and 1".

16. The wrench of claim 14, further including a flexible connector connected at its first end to the removable pin and at its second end to the locking-pin, wherein the flexible connector has a length and flexibility sufficient to allow the removable pin to be inserted into at least one of the first-pin-holes.

* * * * *